US005535950A

United States Patent [19]

Barriac et al.

[11] Patent Number: 5,535,950

[45] Date of Patent: Jul. 16, 1996

[54] DUAL TRIGGER SPRAYER

[75] Inventors: Jacques J. Barriac, Claremont; Douglas B. Dobbs, Yorba Linda; James R. Gillingham, Hacienda Heights; Adonis Spathias, Corona, all of Calif.

[73] Assignee: Calmar Inc., City of Industry, Calif.

[21] Appl. No.: 350,464

[22] Filed: Dec. 7, 1994

[51] Int. Cl.[6] ..... B05B 9/043

[52] U.S. Cl. ..... 239/304; 239/333; 239/398; 239/472; 222/137; 222/255; 222/383.1

[58] Field of Search ..... 239/304, 333, 239/398, 493, 463, 468, 472; 222/135, 137, 144.5, 255, 383.1

[56] References Cited

U.S. PATENT DOCUMENTS

| | | | |
|---|---|---|---|
| 3,303,970 | 2/1967 | Breslau et al. . | |
| 3,760,986 | 9/1973 | Castner et al. | 222/137 |
| 4,335,837 | 6/1982 | Bono | 222/137 |
| 4,826,048 | 5/1989 | Skorka et al. | 222/137 |
| 5,152,431 | 10/1992 | Gardner et al. | 222/136 |
| 5,169,029 | 12/1992 | Behar et al. | 222/1 |
| 5,339,990 | 8/1994 | Wilder | 222/135 |
| 5,402,916 | 4/1995 | Nottingham et al. | 222/144.5 X |
| 5,439,141 | 8/1995 | Clark et al. | 222/383.1 X |
| 5,472,119 | 12/1995 | Park et al. | 222/383.1 X |

FOREIGN PATENT DOCUMENTS

| | | |
|---|---|---|
| 0379627 | 1/1990 | European Pat. Off. . |
| 2641335 | 7/1990 | France . |
| WO95/00436 | 1/1995 | WIPO . |

*Primary Examiner*—Lesley D. Morris
*Attorney, Agent, or Firm*—Watson Cole Stevens Davis

[57] ABSTRACT

A trigger actuated fluid dispenser for simultaneously dispensing disparate fluids separately stored in separate fluid compartments of a container includes side-by-side pump cylinders receiving side-by-side pump pistons reciprocable simultaneously during each pressure stroke applied by a single trigger lever for separately and simultaneously pumping the disparate fluids along separate discharge paths.

11 Claims, 2 Drawing Sheets

FIG. 3
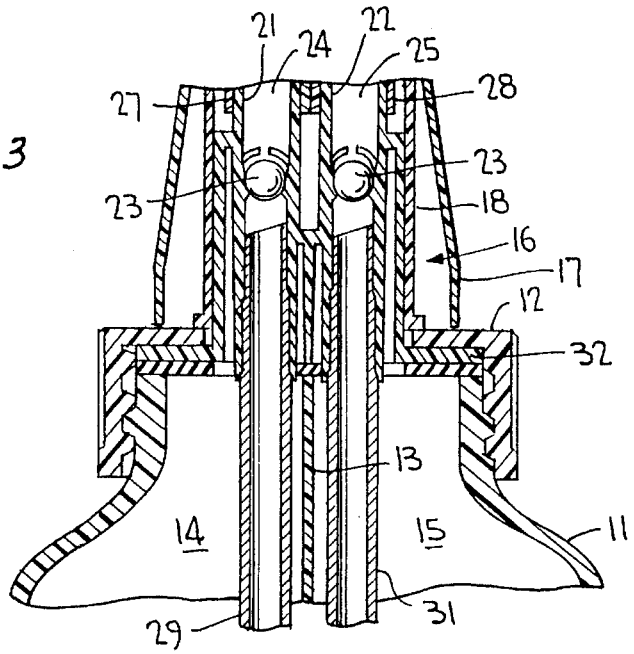
FIG. 4
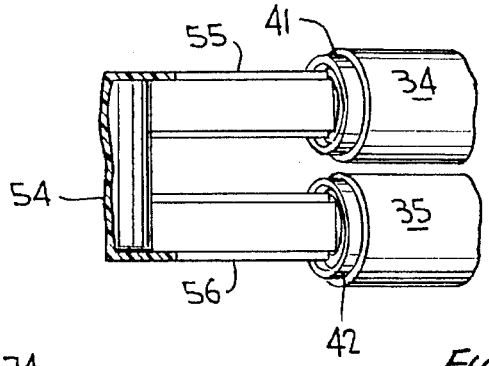
FIG. 7
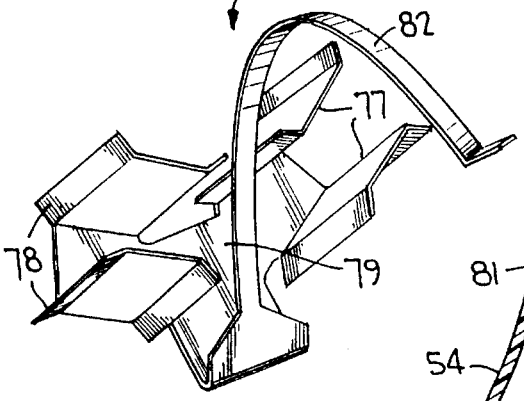
FIG. 6
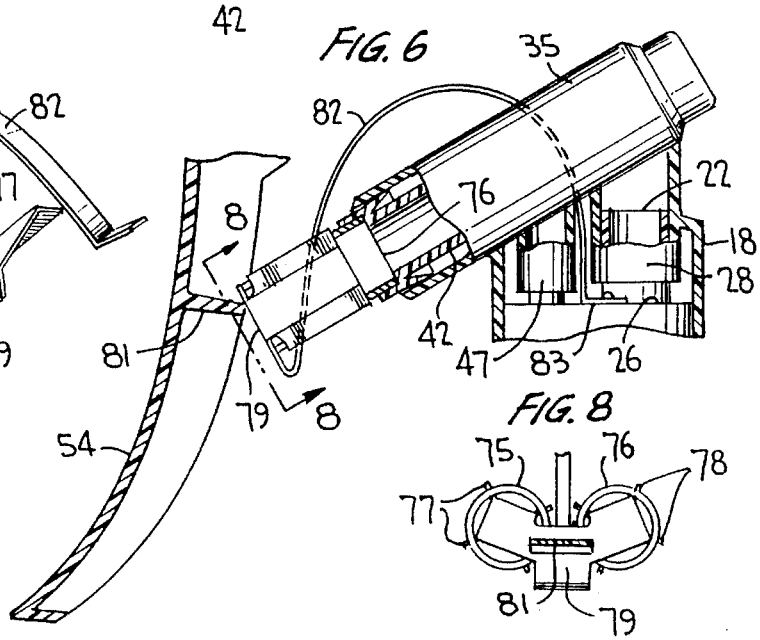
FIG. 8

DUAL TRIGGER SPRAYER

BACKGROUND OF THE INVENTION

This invention relates generally to a fluid dispenser for simultaneously dispensing different fluids separately stored in different fluid compartments, and more particularly to such a dispenser having a pair of side-by-side pump piston and cylinder units relatively reciprocable by a single trigger actuator.

Known fluid dispensers of the upright finger actuated variety are provided for the dispensing of different fluids separately stored in a container or containers to which the dispenser is mounted. Side-by-side pumps are simultaneously actuated upon finger depression of a single pump plunger for simultaneously dispensing separately stored fluids outwardly through a common or separate discharge orifices of the head. Examples of such prior art dispensers are U.S. Pat. Nos. 4,826,048, 3,760,986, 5,169,029, 5,339,990, European Published Application 379,627, and French Patent 2,641,337.

For the dispensing of a wide variety of household products such as cleansing agents and starches, the trigger actuated sprayers are often preferred given the greater container storage capacity offered and the greater pump capacity. For cleaning solutions of different chemicals or different solutions, it is preferable to separately store the disparate fluids and to maintain the fluids separate during pumping and dispensing until they are combined at or downstream of the discharge nozzle.

SUMMARY OF THE INVENTION

It is therefore an object of the present invention to provide a dual trigger sprayer for simultaneously dispensing fluids separately stored in separate fluid compartments, pump means located above a closure cap provided for mounting the dispenser, and the pump means including a pair of side-by-side pump piston and cylinder units relatively reciprocable by a single trigger actuator.

The trigger actuator comprises a trigger lever to effect simultaneous relative reciprocation of the pistons and cylinders against the bias of either internal wet springs located in the pump chambers, or an external dry spring connected at one end to the piston and cylinder units and anchored at its other end to the pump body.

The fluids are discharged along separate paths to the nozzle at which the fluids are swirled together to exit through a single discharge orifice, or at which the fluids are separately swirled to exit through separate discharge orifices. Otherwise, one of the fluids is swirled at the discharge nozzle, and the other fluid negates the swirl for exit of the combined fluids through a single discharge orifice as a relatively narrow spray cone.

Other objects, advantages and novel features of the invention will become more apparent from the following detailed description of the invention when taken in conjunction with the accompanying drawings.

BRIEF DESCRIPTION OF THE DRAWINGS

FIG. 3 is a vertical sectional view taken substantially along the line 3—3 of FIG. 1;

FIG. 4 is a view taken substantially along the line 4—4 of FIG. 1;

FIG. 6 is a view similar to FIG. 1 of another embodiment of a piston return spring assembly and pump actuation means;

FIG. 7 is a perspective view of the FIG. 6 piston return spring assembly;

FIG. 8 is a view taken substantially along the line 8—8 of FIG. 6;

DETAILED DESCRIPTION OF THE INVENTION

Figure 2:
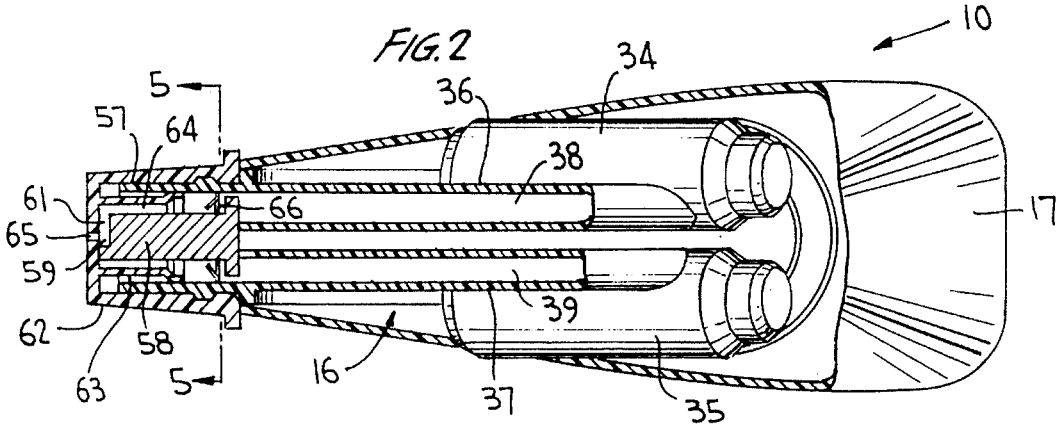
FIG. 2 is a top plan view, mostly in section, of the FIG. 1 trigger sprayer.
Figure 1:
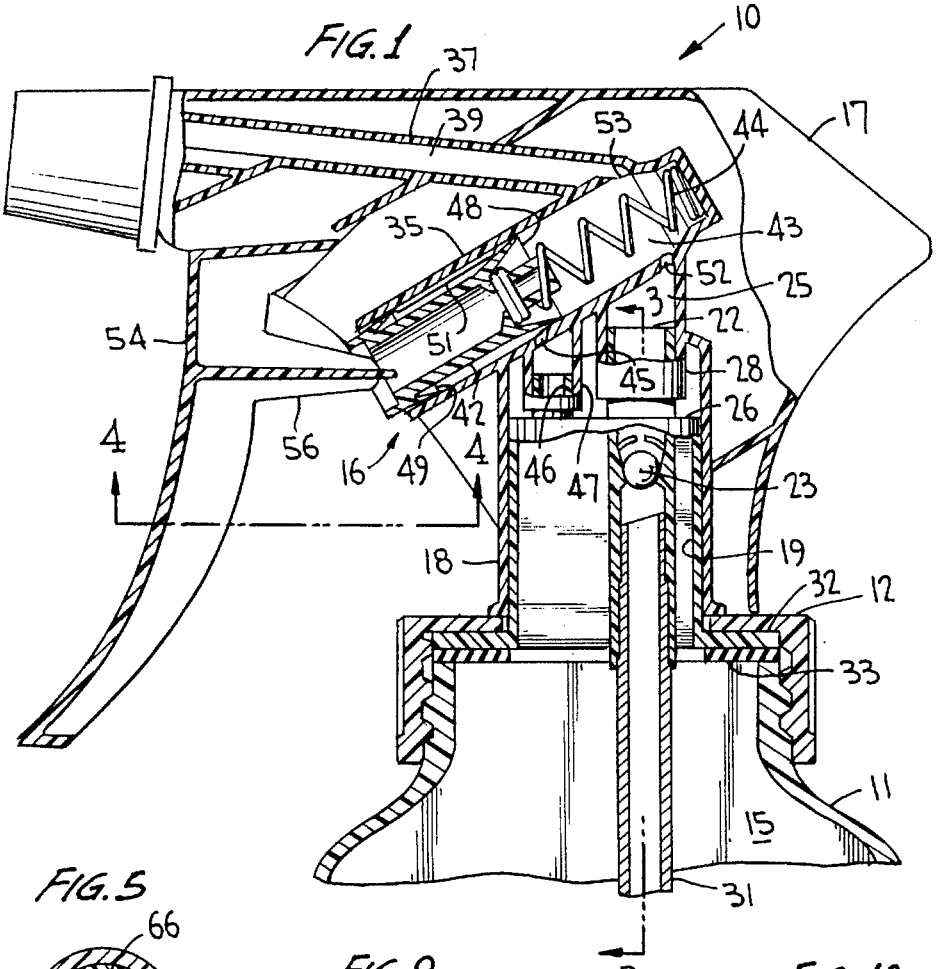
FIG. 1 is a side elevational view, mostly in section, of the dual trigger sprayer according to the invention.

Referring now to the drawings wherein like reference characters refer to like and corresponding parts throughout the several views, the dispenser incorporating the invention is generally designated 10 in FIGS. 1 and 2, the dispenser being mounted to a container 11 with the provision of a threaded closure cap 12. The container has a vertical separator wall 13 (best seen in FIG. 3) defining separate compartments 14 and 15, each for separately storing a disparate fluid. Otherwise, the container may be split into halves forming a common threaded neck between the two halves, each half container defining a separate compartment for the disparate fluids.

Pump body 16 of the dispenser is covered by a suitable shroud 17 and includes an inner cylinder 18 as well as a neck portion 19 tightly fitted within the cylinder in some normal manner. The neck portion has a pair of laterally spaced inlet tubes 21 and 22 (FIG. 3) each containing an inlet ball check valve 23 to define valve controlled inlet passages 24 and 25. The inlet tubes extend through an upper wall 26 of the neck portion, and the upper ends of the tubes sealingly engage within depending sleeves 27 and 28 of the pump body. The lower ends of tubes 21 and 22 support depending dip tubes 29 and 31 respectively extending into fluid compartments 14 and 15 below the level of each fluid contained in each compartment.

Neck portion 19 terminates at its lower end in an annular flange 32 which is engaged by the closure cap to facilitate mounting the dispenser on the container with the provision of an intervening disk seal 33.

The pump body includes a pair of side-by-side pumping units including relatively reciprocable pump cylinders 34 and 35 and pump pistons 41 and 42 located above the closure cap. The pump units are shown as transversely extending at an angle to the central axis of the pump body and its closure cap, although the pump units could lie perpendicular to such central axis or along such central axis, without departing from the invention.

Extending from the respective pump cylinders are discharge barrels 36 and 37 respectively defining discharge passages 38 and 39. Otherwise, a single discharge barrel may be provided having a vertical separator wall defining discharge passages 38 and 39 on opposite sides, without departing from the invention.

The pump cylinders open outwardly and respectively the pump pistons for defining together therewith separate variable volume pump chambers, one of such pump chambers 43 being visible in FIG. 1, the other being the same. As illustrated, the pump pistons are reciprocable within their respective cylinders, although the pistons could be fixed with their respective cylinders relatively reciprocable, within the scope of the invention.

In one embodiment coil return springs 44 are located in each pump chamber extending between the bottom wall of its cylinder and some suitable portion of the piston for relatively extending the piston outwardly of its cylinder to its inoperative position of FIG. 1.

Each pump cylinder has a vent port 45 located outboard of the chamber and in open communication respectively with compartments 14 and 15 of the container. A short tube 46 extending upwardly of wall 26 is tightly fitted within a depending sleeve 47 on pump cylinder 35 to define a vent passage into compartment 15. A similar short tube and sleeve depending from the other pump cylinder are provided for the other vent port to define a vent passage for compartment 14.

Each pump piston has an inboard annular piston seal 48 in sealing engagement with the wall of the pump chamber, and extending in a direction toward the pump chamber. And, each piston has an outboard annular piston seal 49 spaced outwardly of port 45 in all operative positions of the pump. Seal 49 sealingly engages the wall of its pump cylinder in the inoperative position of FIG. 1, is inwardly directed as shown and may be of deformable material.

An axial vent rib 51, or an equivalent vent groove, may be provided at the inner surface of each pump cylinder for interrupting seal 49 during pumping to establish vent passages open to the atmosphere as seal 49 is deformed during contact upon each inward stroke of each piston. Seal 49 of each piston therefore functions as a vent valve, as described in U.S. Pat. Nos. 4,618,077 and 4,747,523, which automatically open simultaneously with inward displacement thereof by ribs 51, with the result that each time a charge of flowable product is delivered through the discharge orifice to atmosphere, a vent passage is in open communication with the atmosphere through the clearance or space between each seal 49 and the inner wall of its cylinder as produced by rib 51. Thus, atmospheric air may be drawn into both compartments of the container through ports 45 as necessary to replenish dispensed product and to avoid hydraulic lock.

Pump chamber 43 has an inlet port 52 in communication with inlet passage 25, and has an outlet port 53 in communication with discharge passage 39. The other pump chamber of cylinder 34 has similar inlet and outlet ports respectively in communication with inlet passage 24 and discharge passage 38.

A single trigger lever 54 is pivotally connected at its upper end to the pump body in some normal manner, and in the FIGS. 1 and 4 embodiment has a pair of rearwardly extending, spaced tups 55 and 56 (FIG. 4) engaging the outer rims of pump pistons 41, and 42, respectively, for manually reciprocating the pistons simultaneously against the force of return springs 44 during trigger actuation.

Figure 9:
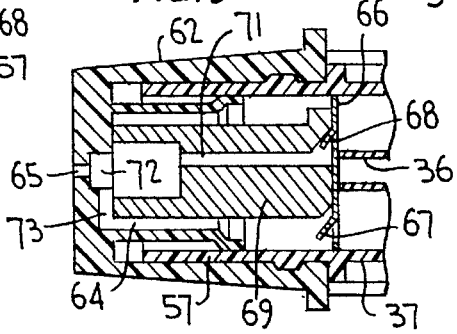
FIG. 9 is a sectional view at the nozzle end of the FIG. 2 trigger sprayer showing another embodiment thereof.
Figure 10:
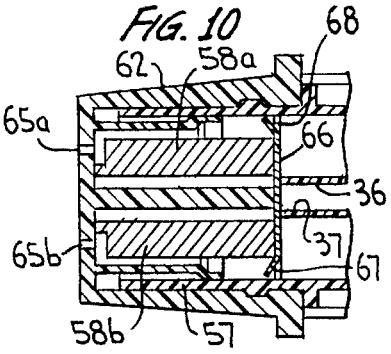
FIG. 10 is a view similar to FIG. 9 of yet another embodiment of the nozzle.

The discharge end or nozzle 57, formed as an extension of discharge barrels 36 and 37, has mounted therein a spinner probe 58 having at its outer end tangential channels 59 extending into a spin chamber 61 of known construction. A nozzle cap 62 is snap-fitted about nozzle 57, and has an inner skirt 63 sealed against the inner surface of nozzle 57 and defining together with the spinner probe longitudinal channels 64 communicating with the tangentials. The nozzle cap has a discharge orifice 65 at the spin chamber. Such a fluid spin mechanics assembly is disclosed in U.S. Pat. No. 4,706,888, commonly owned herewith. And, the FIG. 2 fluid spin mechanics assembly, as well as the alternative assemblies of FIGS. 9 and 10, are similar to that disclosed in a companion U.S. application Ser. No. 08/332,593, filed Oct. 31, 1994, entitled Dual In-Line Trigger Sprayer, and commonly owned herewith.

Figure 5:
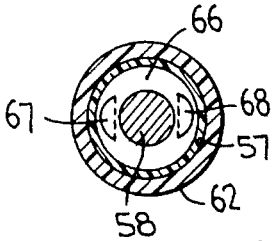
FIG. 5 is a view taken substantially along the line 5—5 of FIG. 2.

An elastomeric discharge valve disc 66 is mounted within the nozzle and may surround around the probe as shown. The valve disc has one-way flap valves 67, 68 (FIG. 5) respectively valving the flow of fluid from discharge passages 38 and 39 to the nozzle.

In operation, once pump chambers 43 are primed with separate disparate fluids, which may be in the form of liquid products such as water and a household cleansing agent, suctioned into the pump chambers from compartments 14 and 15 via the valve controlled inlet passages, each pressure stroke of the pistons simultaneously and separately pumps the fluids along the separate discharge paths 38 and 39 such that the pressurized fluids are forced through valves 67 and 68 for combining at the downstream side of the discharge valve. The combined fluids swirl together in the spin chamber and are discharged through the discharge orifice as a spray of combined fluids.

On each simultaneous return stroke of the pistons, the discharge valves close to facilitate priming as the disparate products from compartments 14 and 15 are suctioned via the valve controlled inlet passages 24 and 25 and inlet ports 52 into their respective pump chambers, to be maintained separated therein as well as during the ensuing pumping action as the separate fluids are discharged along passages 38 and 39 and into the spin mechanics as aforedescribed.

The two pump chambers 43 can be of equal capacity for dispensing equal amounts of disparate fluids during pumping, or one of the pump chambers can be of a different capacity compared to the other for dispensing disproportionate amounts of disparate fluids during pumping.

Other variations of the discharge nozzle end of the dispenser are made possible according to the invention. For example, as shown in FIG. 9, probe 69 may have a longitudinal passage 71 communicating with spin chamber 72 located in the confronting wall of nozzle cap 62 which likewise contains tangential channels 73. Discharge valve disc 66 has its one-way flap valve 68 for valving flow of fluid from passage 38 through passage 71, and has its one-way flap valve 67 for valving fluid from passage 39 into tangential 73 and into spin chamber 72. Thus, the flow of disparate fluids remains separated until the fluids combine in the spin chamber, at which the fluids are swirled to issue through the discharge orifice as a spray. The FIG. 9 arrangement is similar to that disclosed in U.S. application Ser. No. 08/326,230, filed Oct. 20, 1994, entitled Spray Having Variable Spray Pattern, and commonly owned herewith. As more fully described in that application, flow of fluid, in this case fluids, both through the spinner probe and around the probe, have the effect of controlling the conicity of the spray issuing through the discharge orifice as the fluid flowing through passage 71 negates some of the spin velocity of the fluid passing through the tangentials to thereby produce a spray of a lesser conical angle.

As shown in FIG. 10, spinner probes **58*a* and 58*b*, each similar to probe 58 of FIG. 2, are mounted within discharge nozzle 57 and are respectively associated with discharge passages 38 and 39. Nozzle cap 62 has discharge orifices 65*a*** and 65*b* respectively in communication with the spin chambers of the two probes, and discharge valve disc 66 has its valves 68 and 67 respectively for valving the disparate fluids from passages 38 and 39 into the respective spin mechanics.

Thus, the disparate fluids are separately swirled and are discharged through their orifices 65*a* and 65*b* as spray cones to be mixed and combined downstream of the nozzle cap before reaching the spray target.

In accordance with another embodiment of the invention shown in FIGS. 6–8, the internal wet springs 44 can be replaced by a single dry return spring assembly 74. Tubular extensions 75 and 76 are fitted within the outer ends of the pump pistons, one pair of bracket legs 77 of the spring assembly being inserted within extension 75, and another pair of bracket legs 78 of the spring assembly being inserted within extension 76. The bracket leg pairs are interconnected by a bridge plate 79 of the spring assembly which, in the inoperative position of the dispenser shown in FIG. 6, bears against an internal rib 81 of the trigger lever. Such internal rib replaces tups 55 and 56 described with reference to FIG. 1.

Spring assembly 74 further includes a torsion spring 82 or the like connected at one end to bridge plate 79, and bent downwardly then upwardly between the pair of pump cylinders 34, 35 and anchored at its free end 83 to a suitable portion of the pump body such as to upper wall 26 of neck portion 19.

Rib 81 of the trigger lever bears against the central portion of bridge 79 as shown in FIG. 8 to thereby simultaneously reciprocate the pistons inwardly of their cylinder bores during each pressure stroke upon each inward pull of the trigger. The spring force is effectively stored by the torsion spring to act in positively retracting both pistons simultaneously out of their respective cylinders during each pumping return stroke. The abutting engagement between bridge member 79 and rib 81 likewise returns the trigger lever to its inoperative position of FIG. 6.

As in the aforementioned companion application, the trigger lever is neither coupled to spring assembly 74 nor to the pump pistons or their outward extensions, but rather the external spring positively retracts the pistons simultaneously from their bores during the dual piston return stroke, returning the trigger lever to its inoperative position of FIG. 6. With such arrangement, the need for couplers is avoided between the spring assembly and the trigger lever or between the trigger lever and the piston extensions, thereby avoiding additional costs in assembly and parts.

From the foregoing it can be seen that a simple and economical yet highly effective dual trigger sprayer is provided for pumping disparate fluids while separated and for discharging the pumped fluids separately toward the nozzle end of the dispenser to be combined there or downstream of the nozzle cap. Depending on the relative capacity of the pump chambers, either proportionate or disproportionate amounts of fluids can be simultaneously pumped and discharged without the need for separate control devices.

As an alternative to internal wet springs, an external dry spring assembly can be provided for simultaneously extracting the pump pistons out of their respective cylinder bores during the simultaneous return stroke of the pistons, in a simple and effective manner.

Obviously, many other modifications and variations of the present invention are made possible in the light of the above teachings. It is therefore to be understood that within the scope of the appended claims the invention may be practiced otherwise than as specifically described.

What is claimed is:

1. A trigger operated fluid dispenser for simultaneously dispensing first and second fluids separately stored in respective first and second fluid compartments, comprising:

a pump body having pump means in fluid communication with said fluid compartments for simultaneous suctioning fluid therefrom and for discharging suctioned fluid to a common location;

a closure for mounting said pump body to at least one fluid container;

said pump means including a pair of side-by-side pump pistons respectively reciprocable in a pair of side-by-side pump cylinders to therewith define a pair of separate variable volume pump chambers;

a bridge member connected to said pistons;

a trigger lever pivotally mounted to said pump body and engaging said bridge member for simultaneously effecting reciprocation of said pistons upon operation of said trigger lever; and return spring means for spring biasing said pistons during operation of said trigger lever.

2. The dispenser according to claim 1, wherein said spring means comprise a pair of coil springs respectively located in said chambers in engagement with said pistons.

3. The dispenser according to claim 1, wherein said spring means comprises an external spring connected at one end to said bridge member and in engagement at another end with said pump body for spring returning said pistons and for outwardly pivoting said lever during each piston return stroke.

4. A trigger operated fluid dispenser for simultaneously dispensing first and second fluids separately stored in respective first and second fluid compartments, comprising:

a pump body having pump means in fluid communication with said fluid compartments for simultaneous suctioning fluid therefrom and for discharging suctioned fluid to a common location;

a closure for mounting said pump body to at least one fluid container;

said pump means including a pair of side-by-side pump pistons respectively reciprocable in a pair of side-by-side pump cylinders to therewith define a pair of separate variable volume pump chambers;

said pump chambers respectively communicating with said fluid compartments and with a pair of separate discharge passages located in said pump body;

a nozzle on said pump body containing a fluid spin mechanics assembly, said passages opening into said assembly at which the first and second fluids are united before exiting through a discharge orifice as a spray;

actuation means including a trigger lever pivotally mounted to said pump body for simultaneously reciprocating said pistons; and return spring means for spring biasing said pistons during operation of said trigger lever.

5. The dispenser according to claim 4, wherein said fluid spin mechanics assembly includes a spinner probe defining a spin chamber together with a nozzle cap which contains said orifice.

6. A trigger operated fluid dispenser for simultaneously dispensing first and second fluids separately stored in respective first and second fluid compartments, comprising:

a pump body having pump means in fluid communication with said fluid compartments for simultaneous suctioning fluid therefrom and for discharging suctioned fluid to a common location;

a closure for mounting said pump body to at least one fluid container;

said pump means including a pair of side-by-side pump pistons respectively reciprocable in a pair of side-by-side pump cylinders to therewith define a pair of separate variable volume pump chambers;

said pump chambers respectively communicating with said fluid compartments and with a pair of separate discharge passages located in said pump body;

a nozzle on said pump body containing a spinner probe defining together with a surrounding nozzle cap a longitudinal channel leading to a spin chamber via tangential channels, said discharge passages respectively communicating with said channel and with a longitudinal passage extending through said probe leading to the spin chamber and the tangential channels for varying the spray issuing through a discharge orifice in the nozzle cap;

actuation means including a trigger lever pivotally mounted to said pump body for simultaneously reciprocating said pistons; and return spring means for spring biasing said pistons during operation of said trigger lever.

7. A trigger operated fluid dispenser for simultaneously dispensing first and second fluids separately stored in respective first and second fluid compartments, comprising:

a pump body having pump means in fluid communication with said fluid compartments for simultaneous suctioning fluid therefrom and for discharging suctioned fluid to a common location;

a closure for mounting said pump body to at least one fluid container;

said pump means including a pair of side-by-side pump pistons respectively reciprocable in a pair of side-by-side pump cylinders to therewith define a pair of separate variable volume pump chambers;

said pump chambers respectively communicating with said fluid compartments and with a pair of separate discharge passages located in said pump body;

a nozzle on said pump body containing a pair of separate spin mechanics assemblies respectively communicating with said discharge passages, a nozzle cap surrounding said nozzle and having a pair of discharge orifices respectively associated with said assemblies;

actuation means including a trigger lever pivotally mounted to said pump body for simultaneously reciprocating said pistons; and return spring means for spring biasing said pistons during operation of said trigger lever.

8. The dispenser according to claim 7, wherein each of the pair of fluid spin mechanics assemblies includes a spinner probe defining together with said nozzle cap at least one longitudinal channel leading to a spin chamber via tangential channels, said at least one longitudinal channel respectively communicating with said discharge passages.

9. The dispenser according to claims 4, 6 or 7, wherein said lever trigger has a pair of tups in engagement with said pistons for the simultaneous reciprocation thereof.

10. The dispenser according to claims 1, 4, 6 or 7, wherein said pump chambers are of equal fluid capacity to facilitate pumping and dispensing of equal proportions of said fluids.

11. The dispenser according to claims 1, 4, 6 or 7, wherein said pump chambers are of relatively unequal fluid capacities to facilitate pumping and dispensing of disproportionate amounts of said fluids.

* * * * *